US006617024B2

(12) United States Patent
Sudo et al.

(10) Patent No.: US 6,617,024 B2
(45) Date of Patent: Sep. 9, 2003

(54) HOLLOW SHRINKABLE FIBER FOR PILE AND MANUFACTURING METHOD THEREOF, AND PILE PRODUCT

(75) Inventors: Shin Sudo, Hyogo (JP); Satoru Harada, Hyogo (JP)

(73) Assignee: Kaneka Corporation, Osaka (JP)

( * ) Notice: Subject to any disclaimer, the term of this patent is extended or adjusted under 35 U.S.C. 154(b) by 0 days.

(21) Appl. No.: 09/992,670

(22) Filed: Nov. 16, 2001

(65) Prior Publication Data

US 2002/0122937 A1 Sep. 5, 2002

(30) Foreign Application Priority Data

May 18, 1999 (JP) ..... 11-137252
May 17, 2000 (WO) ..... PCT/JP00/03153

(51) Int. Cl.[7] ..... D01F 6/00
(52) U.S. Cl. ..... 428/376; 428/398; 428/395
(58) Field of Search ..... 428/376, 398, 428/395

(56) References Cited

U.S. PATENT DOCUMENTS 4,576,840 A * 3/1986 Murata et al. ..... 428/16
5,344,711 A * 9/1994 Kanzaki et al. ..... 428/398

FOREIGN PATENT DOCUMENTS

| | | |
|---|---|---|
| JP | 48-1220 | 1/1973 |
| JP | 63-315639 | 12/1988 |
| JP | 2-221404 | 9/1990 |

* cited by examiner

*Primary Examiner*—N. Edwards
(74) *Attorney, Agent, or Firm*—Brinks Hofer Gilson & Lione

(57) ABSTRACT

A hollow shrinkable fiber is manufactured by wet spinning a copolymer of acrylonitrile and a halogen-containing vinyl monomer, and then carrying out steam treatment, followed by drying treatment, and then heat treatment, thus forming a marrow-like or network-like hollow portion comprising a large number of voids in a core part of the fiber cross section. The void ratio of the fiber cross section is 10 to 50%, and the dry heat shrinkage percentage of the fiber is at least 15%. The fiber has a hollow form similar to that of natural fur, is excellent in terms of bulkiness, a lightweight feeling and warmth retention, and can be used as down hairs in pile products.

6 Claims, 2 Drawing Sheets

HOLLOW SHRINKABLE FIBER FOR PILE AND MANUFACTURING METHOD THEREOF, AND PILE PRODUCT

"RELATED APPLICATIONS

This application is related to, and claims priority from the following international applications: PCT Application No. PCT/JP00/03153 designating the United States, filed May 17, 2000, and Japan Application 11/137252, filed May 18, 1999."

TECHNICAL FIELD

The present invention relates to a hollow shrinkable fiber that has good shrinkability as well as being excellent in terms of bulkiness, a lightweight feeling and warmth retention, and is suitable for manufacturing pile products.

BACKGROUND ART

In general, hollow fibers have various special features such as having body, being bulky with low apparent density, and having good warmth retention and water absorption properties. The use of hollow fibers in pile products has thus frequently been experimented with. A common pile product is a stepped pile comprising guard hairs and down hairs. A method commonly adopted for manufacturing such a stepped pile is to use non-shrinkable fibers as the guard hair fibers and shrinkable fibers as the down hair fibers, and to carry out heat treatment during the pile processing so that the shrinkable fibers are shrunk and a height difference is produced between the guard hairs comprising the non-shrinkable fibers and the down hairs comprising the shrinkable fibers. Relatively thick fibers are used as the guard hair fibers, and moreover this part of the pile is not required to be shrinkable, and hence there are many cases of hollow fibers being used as the guard hair fibers. However, in a pile product, the number of guard hairs is generally lower than the number of down hairs, and hence the overall bulkiness of the pile product tends to be determined mainly by the bulkiness of the part in which the down hairs are closely gathered. The desired texture, bulkiness and lightweight feeling of a pile product therefore cannot be realized merely by using hollow fibers as the guard hairs. There are thus calls for hollow fibers that are sufficiently thin and shrinkable as to be usable as down hairs. However, the fineness of the fibers used as the down hairs in pile products is 10 dtex or less, generally 2 to 7 dtex, and conventionally it has been difficult to manufacture hollow fibers that are both that thin and satisfy the other properties required of down hair fibers. For example, in the past many acrylic fibers having a single hollow structure, i.e. a single void in the fiber cross section, have been proposed. However, there has been a problem in that, if one attempts to obtain a sufficient void ratio with such a single hollow structure, then the fiber becomes weak due to the reduction in the thickness of the skin part (also called the shell part), which is the outer peripheral part in the fiber cross section, and hence under external pressure the fiber is squashed and does not recover, resulting in it being impossible to achieve the original functions of the hollow fibers, namely bulkiness and a lightweight feeling. To resolve this problem, in Japanese Patent Application Laid-open No. H7-90721, a method is proposed in which a plurality of substantially independent void parts are formed with a uniform spacing therebetween in the fiber cross section, thus obtaining a high void ratio. However, in this method, a modified sheath-core conjugate nozzle is used, leading to problems of industrial productivity being poor and the manufacturing cost being high. Moreover, methods of manufacturing hollow fibers by adding a blowing agent have been disclosed in Japanese Patent Application Laid-open No. S58-149313 and Japanese Patent Application Laid-open No. S62-78210. However, with these methods, there are problems in that there is unevenness in the position of formation and shape of the hollow portion, leading to a drop in colorability and inadequate realization of functions of the hollow fibers such as bulkiness and a lightweight feeling.

An object of the present invention is to resolve the above problems, and to provide a hollow shrinkable fiber for pile having a hollow form similar to that of natural fur, capable of recovering easily after the hollow portion thereof has been squashed under external pressure, having properties such as bulkiness, a lightweight feeling and warmth retention not achievable conventionally, and capable of being used as down hairs in a pile product, along with a method of manufacturing this hollow shrinkable fiber, and a pile product manufactured using the hollow shrinkable fiber.

DISCLOSURE OF THE INVENTION

A hollow shrinkable fiber for pile according to the present invention comprises a synthetic fiber, has a marrow-like or network-like hollow portion comprising a large number of voids in a core part in the fiber cross section, has a void ratio in the fiber cross section of 10 to 50%, and has a dry heat shrinkage percentage of at least 15%. The synthetic fiber preferably comprises a polymer containing a copolymer of acrylonitrile and a halogen-containing vinyl monomer.

Moreover, a method of manufacturing a hollow shrinkable fiber for pile according to the present invention is characterized by carrying out wet spinning of a copolymer of acrylonitrile and a halogen-containing vinyl monomer, and subjecting the wet fiber thus obtained to steam treatment and drying treatment, and then to heat treatment to form a hollow portion in the fiber. It is preferable for the solvent content of the fiber to be reduced to 5 wt % or less through the steam treatment, for the liquid content of the fiber to be made to be 5 to 50 wt % through the drying treatment, and for drawing treatment to be carried out after the heat treatment. Moreover, it is preferable for the heat treatment to be carried out at a temperature in the range 120 to 180° C., and for the fiber to be elongated by a factor of 1.1 to 2.3 at a temperature in the range 90 to 150° C. during the drawing treatment. Moreover, when the fiber obtained through the above-mentioned method is crimped, it is preferable to carry out the crimping by heating to a temperature 1 to 10° C. below the glass transition temperature of the fiber.

The hollow shrinkable fiber for pile of the present invention as described above is suitable for use as the down hairs of a pile product.

Following is a more detailed description of the present invention. The hollow shrinkable fiber of the present invention comprises a synthetic fiber. There are no particular limitations on this synthetic fiber, with examples including an acrylic fiber, a polyamide fiber, a polyester fiber, a polyolefin fiber, a vinyl chloride fiber, a vinylidene chloride fiber and a polyvinyl alcohol fiber. However, from the viewpoint of the product quality and texture of a pile product suitable for use as artificial fur or in stuffed toys or the like, an acrylic fiber is particularly preferable. As such an acrylic fiber, one comprising a copolymer of 30 to 80 wt % of acrylonitrile and 20 to 70 wt % of a monomer copolymerizable with acrylonitrile is preferable. Examples of such a monomer copolymerizable with acrylonitrile include, for example, acrylic acid, methacrylic acid, vinyl chloride, vinylidene chloride, vinyl esters such as vinyl acetate, vinylpyrrolidone, vinylpyridine and alkyl-substituted derivatives thereof, acrylic acid esters, methacrylic acid esters, acrylic acid amides, methacrylic acid amides and monoalkyl- or dialkyl-substituted derivatives thereof, and styrenesulfonic acid, methallylsulfonic acid and metal salts and amine salts thereof. Out of these monomers, to make the fiber fire-resistant, it is preferable to use a halogen-containing vinyl monomer. Vinyl chloride or vinylidene chloride is preferable as this halogen-containing vinyl monomer.

When it is said that there is a hollow portion in the fiber cross section in the present invention, what is meant is that there are one or more voids. In fact, the fiber of the present invention has, as the hollow portion, a marrow-like or network-like hollow portion comprising a large number of voids in a core part of the fiber cross section. This fiber cross section having a marrow-like or network-like hollow portion in the core part thereof is similar to the cross section of a hair in the natural fur of an animal such as a mink or a sable. What is meant by such a fiber cross section is that a large number of voids of different shapes are formed irregularly as in bone marrow or a network in the core part, which is in the center of the fiber cross section (as opposed to the compact skin part, which is at the periphery of the fiber cross section). Examples are shown in FIGS. 1 and 2, wherein the black parts are the voids. The definition of the hollow portion in the fiber cross section in the present invention thus does not include a single (total) hollow, or a hollow portion comprising a large number of voids arranged regularly with a uniform spacing therebetween, as produced, for example, through sheath-core composite spinning.

Moreover, the void ratio of the fiber cross section in the present invention means the proportion of the total area of the fiber cross section (the area of the portion A plus the area of the portion B in the schematic view of the fiber cross section shown in FIG. 3) that is taken up by the area of the marrow-like or network-like hollow portion comprising the large number of irregularly shaped voids (the area of the portion B in FIG. 3, i.e. the total area of the large number of voids that make up the hollow portion). In the fiber of the present invention, it is preferable for this void ratio to be in the range 10 to 50%. If the void ratio is less than 10%, then the inherent properties of a hollow fiber, namely bulkiness and a lightweight feeling, will be poor. If the void ratio is greater than 50%, on the other hand, then the skin part will be thin and the fiber will be weak to external pressure, leading to rupture, and hence again to the bulkiness and lightweight feeling being poor. To give an acrylic fiber a sufficient lightweight feeling, it is thus preferable for the void ratio to be in the range 20 to 40%.

Moreover, the fiber of the present invention is a shrinkable fiber having a dry heat shrinkage percentage of at least 15%. In the present invention, the dry heat shrinkage percentage is the shrinkage percentage determined from the length of the fiber before shrinkage and the length of the fiber after shrinking by carrying out heat treatment for 20 minutes at a temperature of 100 to 150° C. in a convection oven type dryer. It is undesirable for the dry heat shrinkage percentage of the fiber to be less than 15%, since in this case, when the fiber is used as a down hair fiber in a pile product, the height difference effect obtained though the difference in shrinkage between the guard hair fibers and the down hair fibers will tend not to be sufficiently obtained. Moreover, although there is no limitation on the maximum value of the dry heat shrinkage percentage of the fiber, this maximum value will be about the same as ordinary shrinkable fibers, namely about 30%. The dry heat shrinkage percentage of the hollow shrinkable fiber of the present invention is thus generally in the range 15 to 35%.

To manufacture the hollow shrinkable fiber of the present invention, an acrylic copolymer as described above is dissolved in an organic solvent such as acetone, acetonitrile, dimethylformamide or dimethylsulfoxide, or an inorganic solvent such as zinc chloride, nitric acid or thiocyanogen, to produce a spinning stock solution, and then wet spinning is carried out using this spinning stock solution. So long as there is no impediment to the spinning, additives such as inorganic or organic pigments or stabilizers that improve corrosion prevention, coloration prevention, light fastness or the like may be added to the spinning stock solution. The wet fiber obtained from the wet spinning is next subjected to steam treatment so as to reduce the solvent content to preferably no more than 5 wt %, more preferably no more than 3 wt %. Solvent is removed from the fiber through this steam treatment, and hence the fiber, which was in a wet state, gradually coagulates, resulting in a relatively compact skin part forming at the periphery of the fiber cross section, and moreover a relatively coarse core part forming in the center of the fiber cross section. The steam treatment is preferably carried out using saturated water vapor. Next, the fiber is dried to adjust the liquid content—which includes both the solvent and water—to be in a prescribed range, and make the fiber more compact. Even though this drying treatment is carried out, because solvent was removed through the steam treatment, the inside of the fiber is not prone to becoming completely compact, but rather remains in a state in which a hollow portion can be formed easily during subsequent processing. Nevertheless, if the fiber were made completely compact right through to the inside through harsh drying treatment, then it would not be possible to form a hollow portion inside the fiber through the subsequent heat treatment. It is thus preferable to carry out the drying treatment under gentle conditions. Specifically, the extent of the drying treatment should be such as to remove moisture from the fiber which has become moist through the steam treatment after the wet spinning, and also to eliminate through heat fusion microvoids that have appeared in the relatively compact skin part. The drying treatment can be carried out using publicly known equipment, but the temperature and time are set such that, through the drying treatment, the liquid (water plus solvent) content of the fiber becomes preferably 5 to 50 wt %, more preferably 10 to 30 wt %. By adjusting the liquid content of the fiber to be in such a range, a compact skin part and a coarse core part are formed. Next, the fiber having the compact skin part and the coarse core part is subjected to heat treatment at a temperature higher than that of the above drying treatment, thus forming a marrow-like or network-like hollow portion comprising a large number of voids in the core part in the center of the fiber cross section. Specifically, because the skin part of the fiber has a compact structure, a regular fiber structure is formed in the axial (length) direction of the fiber through the heat treatment, resulting in a strong continuous structure. The coarse core part in the center of the fiber cross section, on the other hand, remains coarse, and it is thought that shrinkage occurs at random through shrinkage stress and the like due to the heat, resulting in formation of irregular voids of different shapes in the core part, i.e. in the formation of a hollow portion. The heat treatment may be carried out through normal dry heat treatment or wet heat treatment using a hot air current or the like, or in a constant temperature bath using an organic compound such as polyethylene glycol or glycerine; one such method may be used, or two or more methods may be used in combination. The heat treatment is preferably carried out at 120 to 180° C. By carrying out heat treatment under such conditions, a hollow portion is formed and a fiber having a void ratio of 10 to 50% can be obtained. For example, in the case of an acrylic fiber, it is undesirable for the heat treatment to be carried out at above 180° C., since excessive shrinkage will then be prone to occur. Moreover, if the heat treatment is carried out at below 120° C., then there will be insufficient heat conduction, and hence it will not be possible to obtain a high void ratio. For such reasons, it is yet more preferable to carry out the heat treatment at a temperature in the range 140 to 160° C. During the heat treatment, 5 to 15% relaxation may also be carried out.

Furthermore, to make the dry heat shrinkage percentage of the fiber at least 15%, it is necessary to carry out drawing treatment. For example, in the case of an acrylic fiber, a shrinkage percentage of at least 15% can be obtained by drawing by a factor of 1.1 to 2.3 at a drawing temperature of 90 to 15° C. If the drawing temperature is less than 90° C., then heat conduction will be insufficient, and it will be difficult to draw to the prescribed draw magnification. If, on the other hand, the drawing temperature is greater than 150° C., then a high shrinkage percentage will be obtained, but it will be necessary to heat to a high temperature when shrinking the fiber during pile processing or the like, and hence such a high drawing temperature is undesirable. For such reasons, it is yet more preferable for the drawing temperature to be in the range 105 to 135° C.

Note that, with objects such as improving the ease of carrying out shrinkage processing during pile manufacture and improving the texture of the pile product, it is possible to apply a silicone oil or the like onto the fiber, so long as there is no impediment of the objects of the present invention. The oil application may be carried out either before or after the drying treatment.

Furthermore, to manufacture a pile product through sliver knitting using a fiber obtained as described above, it is necessary for producing the sliver to crimp the fiber. In this case, the fiber is preferably crimped by heating to a temperature 1 to 10° C. below the glass transition temperature of the synthetic resin that makes up the fiber. The reason for this is that, if crimping is carried out at a temperature equal to or above the glass transition temperature, then thermal setting of the fiber structure will occur during the crimping, and hence the fiber will become fixed in a state in which the hollow portion is squashed and unable to recover, whereas if the heating temperature during the crimping is too low, then, although the hollow portion will be able to recover after being squashed, rupture will occur during hollow portion formation in some of the fibers, and hence it will not be possible to obtain a sufficient feeling of volume; moreover, if the heating temperature during the crimping is 20° C. or more below the glass transition temperature, then crimp formation will be poor, and it will not be possible to produce the sliver.

An example of a method of obtaining a pile product from the hollow shrinkable fiber of the present invention is to cut the crimped hollow shrinkable fiber to a prescribed fiber length, blend such cut crimped hollow shrinkable fibers with non-shrinkable fibers that have been crimped with a shrinkage percentage of not more than 10% and have a fiber length at least 10 mm longer than that of the hollow shrinkable fibers to make a sliver, then carry out knitting using a high pile knitting machine, next coat the rear face of the pile thus obtained with an acrylic acid ester adhesive and carry out drying treatment for 3 to 10 minutes in a temperature range of 120 to 150° C. to shrink the hollow shrinkable fibers, and then carry out a combination of high/medium/low temperature polishing and shirring to finish to a high pile.

In such a pile product, it is preferable for the hollow shrinkable fiber of the present invention to be used as the down hairs as described above. As the guard hairs, on the other hand, it is preferable to use a non-shrinkable fiber; a normal non-shrinkable fiber may be used, but a publicly known non-shrinkable hollow fiber is more preferable. Moreover, it is also possible to manufacture a pile product using the hollow shrinkable fiber of the present invention for the whole pile product, thus obtaining a pile product having an excellent feeling of volume.

BEST MODE FOR CARRYING OUT THE INVENTION

Following is a more detailed description of the present invention through embodiments, although it should be noted that the present invention is not limited whatsoever to these embodiments. Now, before the description of the embodiments, a description will be given of the measurement and evaluation methods.

Calculation of Void Ratio

Figure 1:
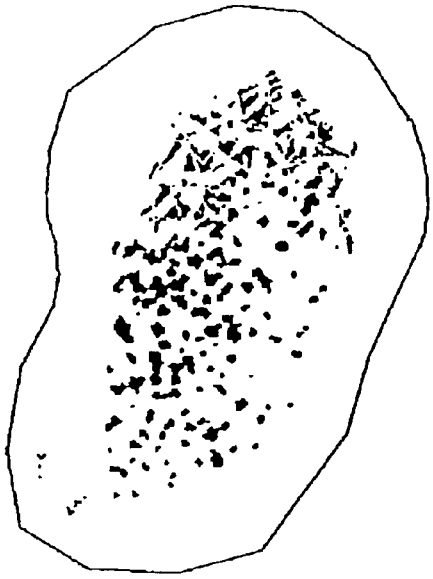
FIG. 1 is a cross-sectional view of an example of a shrinkable fiber having a marrow-like or network-like hollow portion in a core part thereof, which was obtained by using image processing software to convert a scanning electron micrograph of the fiber cross section into a black-and-white image, thus clearly showing the voids and the other parts.
Figure 2:
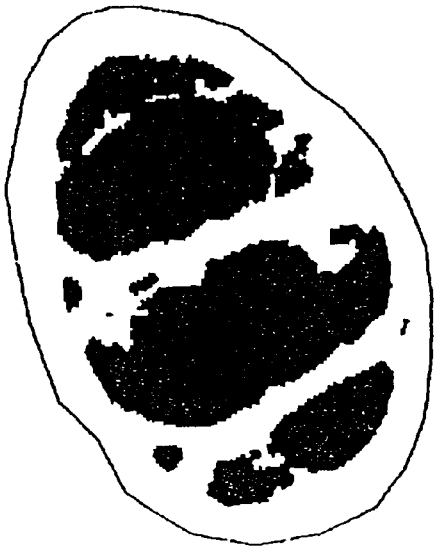
FIG. 2 is a cross-sectional view of another example of a shrinkable fiber having a marrow-like or network-like hollow portion in a core part thereof, which was obtained by using image processing software to convert a scanning electron micrograph of the fiber cross section into a black-and-white image, thus clearly showing the voids and the other parts.
Figure 3:
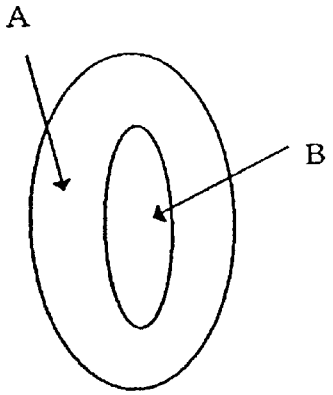
FIG. 3 is a schematic view of the fiber cross section of a hollow shrinkable fiber.

The cross-section of a fiber bundle used as a sample was photographed using a scanning electron microscope with the magnification set such that the cross sections of about 100 of the fibers in the bundle fitted into the field of view. Twenty out of the 100 or so photographed fiber cross sections were then sampled at random, and for each of the fiber cross sections, the void ratio was calculated using the undermentioned formula from the area of the marrow-like or network-like hollow portion (portion B in FIG. 3) comprising a large number of voids positioned in a core part in the center of the fiber cross section (i.e. the total area of the voids) and the area of the remaining portion (portion A in FIG. 3). The void ratio of the fiber in question was then taken as the average value over the twenty fiber cross sections.

$$\text{Void ratio } (\%) = [\text{Area of } B / \text{Area of } (A+B)] \times 100$$

Typical methods of measuring the areas are to use a planimeter or to perform calculations based on weight ratios.

However, if, for example, the image analysis software Image Hyper II made by Inter Quest, which can be used on an ordinary personal computer available on the market, is used to convert to a black-and-white image, thus allowing the void parts in the marrow-like or network-like hollow portion and the remaining parts to be clearly distinguished and hence the areas thereof to be measured, then more accurate values can be obtained. In the embodiments of the present invention, the fiber cross-sectional areas were measured using this image analysis software.

Calculation of Bulkiness

The bulkiness was calculated using the undermentioned formula, with the conditions being the same as for the calculation of the void ratio.

$$\text{Bulkiness}=\text{Area of }(A+B)/\text{Area of }B$$

Calculation of Solvent Content and Water Content 5 g of the fiber to be subjected to measurement was immersed in 200 g of pure water, the solvent in the fiber was leached out by boiling at 95° C., and the volatile component was refluxed using a reflux condenser. The fiber was then removed and dried for 3 hours at 100 to 120° C., and then the weight of the fiber was measured. Moreover, the concentration of the organic solvent or inorganic solvent in the solution into which the solvent was leached out was measured using a gas chromatograph (GC-14B) made by Shimadzu. The solvent content and the water content were then calculated from the following formulae, wherein $F_W$ is the fiber weight before immersion, $F_D$ is the fiber weight after drying, and C is the solvent concentration in the solution into which the solvent was leached out.

$$\text{Solvent content }(S;\%)=[C(200+F_W-F_D)/F_D]\times 100$$

$$\text{Water content }(\%)=[(F_W-F_D)/F_D]\times 100-S$$

Wet Heat Shrinkage Percentage

A load of $8.83\times10^{-3}$cN per 1 dtex was applied to the fiber, and the length ($L_W$) of the fiber was measured. The fiber in an unloaded state was then shrunk by carrying out steam treatment under constant pressure ($1\times10^5$Pa) for 30 minutes, and was then left to cool to room temperature, before once again applying a load of $8.83\times10^{-3}$cN per 1 dtex and measuring the fiber length ($L'_W$). The shrinkage percentage was calculated from the fiber lengths before and after shrinkage $L_W$ and $L'_W$ using the following formula.

$$\text{Shrinkage percentage }(\%)=[(L_W-L'_W)/L_W]\times 100$$

Dry Heat Shrinkage Percentage

The length of the fiber before and after shrinkage was measured using the same method as for the wet heat shrinkage percentage, only the shrinkage was carried out by treating in a convection oven type dryer at 130° C. for 20 minutes. The shrinkage percentage was calculated from the following formula, wherein $L_D$ is the fiber length before shrinkage and $L'_D$ the fiber length after shrinkage.

$$\text{Shrinkage percentage }(\%)=[(L_D-L'_D)/L_D]\times 100$$

Measurement of Glass Transition Temperature (Tg)

A DSC-120 differential thermal analyzer made by Seiko Instruments was used. The sample fiber was finely cut to produce a powder, 10 mg of the powder was weighed out and set into the above-mentioned analyzer, and measurements were taken over the temperature range 30 to 180° C., with the rate of temperature rise being 2° C. per minute. Specifically, 'DTA Tg' was selected from the DSC-120 analysis jobs and a point was designated on the baseline either side of the glass transition temperature (total 2 points), whereupon the glass transition temperature was calculated automatically.

Embodiment 1

Figure 4:
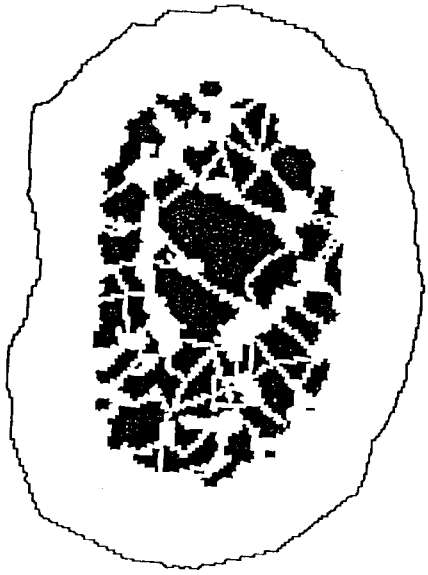
FIG. 4 is a cross-sectional view of the hollow shrinkable fiber of Embodiment 1, which was obtained by using image processing software to convert a scanning electron micrograph of the fiber cross section into a black-and-white image, thus clearly showing the voids and the other parts.

30 wt % of an acrylic copolymer comprising 52.5 parts by weight of acrylonitrile, 1.2 parts by weight of sodium styrenesulfonate and 46.3 parts by weight of vinylidene chloride was put into acetone to make a spinning stock solution. The spinning stock solution was wet spun through a spinneret having 15000 circular orifices each of diameter 0.09 mm into a first coagulation bath held at 20° C. containing 30 wt % of acetone in water, and the spun fibers were then passed into a second coagulation bath held at 25° C. containing 25 wt % of acetone in water, where drawing by a factor of 1.5 was carried out. The fibers were then passed into a wash bath of water at 40° C., and then into hot water at 75° C., where drawing by a factor of 2.0 was carried out. The acetone content of the fibers thus obtained was 10 wt %. The fibers were then subjected to steam treatment using saturated water vapor at 98° C. for 170 seconds. The acetone content of the fibers after the steam treatment was 1.8 wt %. The fibers were next subjected to low-temperature drying at 50° C. for 6 minutes, thus reducing the water content to 19 wt % and the acetone content to 1.2 wt %. The fibers were then subjected to dry heat treatment at 160° C. for 10 seconds, thus forming a hollow structure in each fiber. After that, the fibers were subjected to hot drawing treatment, being drawn by a factor of 2.2 at 120° C. using a vapor quantity of 100 Kg/h. The fibers obtained after passing through all of the above steps had a fineness of 2.4 dtex. Moreover, when the fiber cross section was observed with binarization being carried out using an image processor, it was found that, as shown in FIG. 4, there was a marrow-like or network-like hollow portion comprising a large number of voids (the black parts in FIG. 4) in the core part in the center of the fiber cross section.

Embodiment 2

2.9 wt % of carbon black was mixed into the spinning stock solution used in Embodiment 1, and then wet fibers were obtained by wet spinning under the same conditions as in Embodiment 1 using a spinneret having 5000 circular orifices each of diameter 0.09 mm. The fibers were then subjected to steam treatment using saturated water vapor at 98° C. for 74 seconds. The acetone content of the fibers after the steam treatment was 0.9 wt %. The fibers were next subjected to low-temperature drying at 50° C. for 3 minutes, thus making the water content 31.4 wt % and the acetone content 0.4 wt %. The fibers were then subjected to dry heat treatment at 160° C. for 10 seconds, thus forming a hollow structure in each fiber. After that, the fibers were subjected to hot drawing treatment, being drawn by a factor of 2.2 at 120° C. using a vapor quantity of 100 Kg/h.

Embodiment 3

30 wt % of an acrylic copolymer comprising 52.5 parts by weight of acrylonitrile, 1.2 parts by weight of sodium styrenesulfonate and 46.3 parts by weight of vinylidene chloride was put into acetone to make a spinning stock solution. The spinning stock solution was wet spun through a spinneret having 13334 circular orifices each of diameter 0.11 mm into a first coagulation bath held at 20° C. containing 30 wt % of acetone in water, and the spun fibers were then passed into a second coagulation bath held at 25° C. containing 25 wt % of acetone in water, where drawing by a factor of 1.5 was carried out. The fibers were then passed into a wash bath of water at 40° C., and then into hot water at 75° C., where drawing by a factor of 2.0 was carried out. The acetone content of the fibers thus obtained was 10 wt %. The fibers were then subjected to steam treatment using saturated water vapor at 98° C. for 170 seconds. The acetone content of the fibers after the steam treatment was 1.6 wt %. The fibers were next subjected to low-temperature drying at 50° C. for 6 minutes, thus reducing the water content to 14 wt % and the acetone content to 1.1 wt %. The fibers were then subjected to dry heat treatment at 160° C. for 10 seconds, thus forming a hollow structure in each fiber. After that, the fibers were subjected to hot drawing treatment, being drawn by a factor of 2.2 at 120° C. using a vapor quantity of 100 Kg/h. The fibers obtained after passing through all of the above steps had a fineness of 2.4 dtex.

Embodiment 4

29.5 wt % of an acrylic copolymer comprising 49.0 parts by weight of acrylonitrile, 0.5 parts by weight of sodium styrenesulfonate and 50.5 parts by weight of vinyl chloride was put into acetone to make a spinning stock solution. The spinning stock solution was wet spun through a spinneret having 15000 circular orifices each of diameter 0.09 mm into a first coagulation bath held at 20° C. containing 30 wt % of acetone in water, and the spun fibers were then passed into a second coagulation bath held at 25° C. containing 25 wt % of acetone in water, where drawing by a factor of 1.5 was carried out. The fibers were then passed into a wash bath of water at 40° C., and then into hot water at 75° C., where drawing by a factor of 2.0 was carried out. The acetone content of the fibers thus obtained was 9.3 wt %. The fibers were then subjected to steam treatment using saturated water vapor at 98° C. for 170 seconds. The acetone content of the fibers after the steam treatment was 0.6 wt %. The fibers were next subjected to low-temperature drying at 50° C. for 6 minutes, thus reducing the water content to 17.3 wt %; the acetone content remained at 0.6 wt %. The fibers were then subjected to dry heat treatment at 150° C. for 15 seconds, thus forming a hollow structure in each fiber. After that, the fibers were subjected to hot drawing treatment, being drawn by a factor of 2.0 at 110° C. using a vapor quantity of 100 Kg/h.

Embodiment 5

2.9 wt % of carbon black was mixed into the spinning stock solution used in Embodiment 4, and wet spinning was carried out under the same conditions as in Embodiment 1 using a spinneret having 5000 circular orifices each of diameter 0.09 mm. The fibers thus obtained were then subjected to steam treatment using saturated water vapor at 98° C. for 100 seconds. The acetone content of the fibers after the steam treatment was 1.3 wt %. The fibers were next subjected to low-temperature drying at 50° C. for 5 minutes, thus making the water content 21.7 wt % and the acetone content 0.6 wt %. The fibers were then subjected to dry heat treatment at 150° C. for 10 seconds, thus forming a hollow structure in each fiber. After that, the fibers were subjected to hot drawing treatment, being drawn by a factor of 2.0 at 120° C. using a vapor quantity of 100 Kg/h.

Comparative Example 1

The spinning stock solution used in Embodiment 1 was wet spun through a spinneret having 15000 circular orifices each of diameter 0.09 mm into a first coagulation bath held at 20° C. containing 30 wt % of acetone in water, and the spun fibers were then passed into a second coagulation bath held at 25° C. containing 25 wt % of acetone in water, where drawing by a factor of 1.5 was carried out. The fibers were then passed into a wash bath of water at 40° C., and then into hot water at 75° C., where drawing by a factor of 2.0 was carried out. The acetone content of the fibers thus obtained was 12 wt %. The fibers were next subjected to low-temperature drying at 50° C. for 6 minutes, thus reducing the water content to 32 wt % and the acetone content to 2.2 wt %. The fibers were then subjected to dry heat treatment at 160° C. for 10 seconds. After that, the fibers were subjected to hot drawing treatment, being drawn by a factor of 2.2 at 120° C. using a vapor quantity of 100 Kg/h. The result of the above was that, although a hollow portion was formed in each fiber through the low-temperature drying at 50° C., because the wet fibers were not subjected to steam treatment before the drying, the fibers were made compact by the drying, and hence satisfactory hollow fibers could not be obtained.

Comparative Example 2

A spinning stock solution the same as that used in Embodiment 1 was wet spun through a spinneret having 15000 circular orifices each of diameter 0.09 mm into a first coagulation bath held at 20° C. containing 30 wt % of acetone in water, and the spun fibers were then passed into a second coagulation bath held at 25° C. containing 25 wt % of acetone in water, where drawing by a factor of 1.5 was carried out. The fibers were then passed into a wash bath of water at 40° C., and then into hot water at 75° C., where drawing by a factor of 2.0 was carried out. The acetone content of the fibers thus obtained was 10 wt %. The fibers were then subjected to steam treatment using saturated water vapor at 98° C. for 170 seconds. The acetone content of the fibers after the steam treatment was 1.8 wt %. The fibers were next subjected to low-temperature drying at 50° C. for 3 minutes, thus reducing the water content to 58 wt %; the acetone content becoming to 2.2 wt %. The fibers were then subjected to dry heat treatment at 160° C. for 10 seconds. After that, the fibers were subjected to hot drawing treatment, being drawn by a factor of 2.2 at 120° C. using a vapor quantity of 100 Kg/h. The result of the above was that, because the liquid content of the fibers after the drying was high, the fibers ruptured during the heat treatment step, and hollow fibers could not be obtained.

Comparative Example 3

A spinning stock solution the same as that used in Embodiment 1 was wet spun through a spinneret having 15000 circular orifices each of diameter 0.09 mm into a first coagulation bath held at 20° C. containing 30 wt % of acetone in water, and the spun fibers were then passed into a second coagulation bath held at 25° C. containing 25 wt % of acetone in water, where drawing by a factor of 1.5 was carried out. The fibers were then passed into a wash bath of water at 40° C., and then into hot water at 75° C., where drawing by a factor of 2.0 was carried out. The acetone content of the fibers thus obtained was 10 wt %. The fibers were then subjected to steam treatment using saturated water vapor at 98° C. for 170 seconds. The acetone content of the fibers after the steam treatment was 1.8 wt %. The fibers were next subjected to low-temperature drying at 50° C. for 6 minutes, thus reducing the water content to 20 wt % and the acetone content to 1.3 wt %. The fibers were then subjected to dry heat treatment at 100° C. for 10 seconds. After that, the fibers were subjected to hot drawing treatment, being drawn by a factor of 2.2 at 120° C. using a vapor quantity of 100 Kg/h. The result of the above was that, because the temperature during the heat treatment was low at 100° C., the solvent in the fibers did not vaporize, and hence hollow fibers could not be obtained.

Comparative Example 4

30 wt % of an acrylic copolymer comprising 52.5 parts by weight of acrylonitrile, 1.2 parts by weight of sodium styrenesulfonate and 46.3 parts by weight of vinylidene chloride was put into acetone to make a spinning stock solution. The spinning stock solution was wet spun using a spinneret having 15000 holes each of diameter 0.09 mm, and then the same manufacturing method as in Embodiment 1 was used to obtain hollow fibers. The fibers were then subjected to hot drawing treatment, being drawn by a factor of 2.2 at 140° C. using a vapor quantity of 100 Kg/h, and then to 10% relaxation treatment at 155° C.

Comparative Example 5

30 wt % of an acrylic copolymer comprising 49.0 parts by weight of acrylonitrile, 0.5 parts by weight of sodium styrenesulfonate and 50.5 parts by weight of vinyl chloride was put into acetone to make a spinning stock solution. The spinning stock solution was wet spun using a spinneret having 15000 holes each of diameter 0.09 mm, and then the same manufacturing method as in Embodiment 1 was used to obtain hollow fibers. The fibers were then subjected to hot drawing treatment, being drawn by a factor of 2.2 at 130° C. using a vapor quantity of 100 Kg/h, and then to 10% relaxation treatment at 145° C.

The evaluation results for the fibers obtained in above-mentioned Embodiments 1 to 5 and Comparative Examples 1 to 5 are shown in Table 1.

TABLE 1

| | Fineness (dtex) | Wet heat shrinkage percentage (%) | Dry heat shrinkage percentage at 130° C. (%) | Void ratio (%) |
|---|---|---|---|---|
| Embodiment 1 | 2.4 | 22.0 | 15.7 | 23 |
| Embodiment 2 | 2.2 | 20.0 | 15.0 | 17 |
| Embodiment 3 | 2.4 | 28.8 | 20.5 | 25 |
| Embodiment 4 | 3.1 | 32.0 | 28.0 | 30 |
| Embodiment 5 | 2.5 | 30.5 | 25.0 | 28 |
| Comparative Example 1 | 2.4 | 21.7 | 15.4 | 10 |
| Comparative Example 2 | 2.3 | 22.3 | 16.0 | — |
| Comparative Example 3 | 2.4 | 21.9 | 15.6 | 0 |
| Comparative Example 4 | 2.6 | 4.8 | 2.8 | 15 |
| Comparative Example 5 | 2.5 | 7.5 | 3.8 | 14 |

As shown in Table 1, hollow shrinkable fibers having a void ratio in the range 10 to 50% and a dry heat shrinkage percentage of at least 15% can be obtained through the method of the present invention.

Embodiment 6

The hollow shrinkable acrylic fibers of Embodiment 4 were cut to a fiber length of 38 mm, and were blended in a 40:60 ratio with non-shrinkable acrylic fibers having a fineness of 17 dtex, a fiber length of 51 mm and a flat cross section (RCL made by Kaneka), to produce a sliver. Knitting was then carried out, followed by pre-polishing and pre-shirring, and then the pile length was evened up to 17 mm. The rear face of the pile was then coated with an acrylic acid ester adhesive, and during drying, the hollow shrinkable acrylic fibers were shrunk. After that, a combination of 155° C., 120° C. and 90° C. polishing and shirring was carried out, thus producing a high pile having a pile length of 23 mm.

Embodiment 7

The hollow shrinkable acrylic fibers of Embodiment 4 were cut to a fiber length of 38 mm, and were blended in a 40:60 ratio with non-shrinkable acrylic fibers having a fineness of 17 dtex, a fiber length of 51 mm and a hollow cross section, to produce a sliver. Knitting was then carried out, followed by pre-polishing and pre-shirring, and then the pile length was evened up to 17 mm. The rear face of the pile was then coated with an acrylic acid ester adhesive, and during drying, the hollow shrinkable acrylic fibers were shrunk. After that, a combination of 155° C., 120° C. and 90° C. polishing and shirring was carried out, thus producing a high pile having a pile length of 23 mm.

Comparative Example 6

Shrinkable acrylic fibers having a cocoon-like cross section, a fineness of 4.4 dtex and a fiber length of 38 mm (AHP made by Kaneka) were blended in a 40:60 ratio with non-shrinkable acrylic fibers having a fineness of 17 dtex, a fiber length of 51 mm and a flat cross section (RCL made by Kaneka), to produce a sliver. Knitting was then carried out, followed by pre-polishing and pre-shirring, and then the pile length was evened up to 17 mm. The rear face of the pile was then coated with an acrylic acid ester adhesive, and during drying, the shrinkable acrylic fibers were shrunk. After that, a combination of 155° C., 120° C. and 90° C. polishing and shirring was carried out, thus producing a high pile having a pile length of 23 mm.

The pile products obtained in above-mentioned Embodiments 6 and 7 and Comparative Example 6 were evaluated as follows. The results are shown in Table 2.

Pile Evaluation

The feeling of volume and the lightweight feeling were evaluated for the manufactured high piles by five experts (technologists involved in the manufacturing of pile fabrics), with the following four levels being used.

1 to 0 points: Unsatisfactory (x)

4 to 6 points: Somewhat satisfactory (Δ)

7 to 9 points: Satisfactory (○)

10 points: Highly satisfactory (◎)

TABLE 2

| | Guard hairs | Down hairs | Feeling of volume | Lightweight feeling |
|---|---|---|---|---|
| Embodiment 6 | Ordinary non-shrinkable fibers | Hollow shrinkable fibers | ○ | ○ |
| Embodiment 7 | Hollow non-shrinkable fibers | Hollow shrinkable fibers | ◎ | ◎ |

TABLE 2-continued

| | Guard hairs | Down hairs | Feeling of volume | Lightweight feeling |
|---|---|---|---|---|
| Comparative Example 6 | Ordinary non-shrinkable fibers | Ordinary shrinkable fibers | Δ | x |

1 to 3 points: Unsatisfactory (x)
4 to 6 points: Somewhat satisfactory (Δ)
7 to 9 points: Satisfactory (○)
10 points: Highly satisfactory (◎)

It can be seen from the results in Table 2 that a pile product having an excellent feeling of volume and an excellent lightweight feeling was obtained when the hollow shrinkable fiber of the present invention was used for the down hairs, with the feeling of volume and the lightweight feeling being even better if a hollow fiber was also used for the guard hairs.

Embodiments 8, 9

30 wt % of an acrylic copolymer comprising 52.5 parts by weight of acrylonitrile, 1.2 parts by weight of sodium styrenesulfonate and 46.3 parts by weight of vinylidene chloride was put into acetone to make a spinning stock solution. The spinning stock solution was wet spun through a spinneret having 15000 circular orifices each of diameter 0.09 mm into a first coagulation bath held at 20° C. containing 30 wt % of acetone in water, and the spun fibers were then passed into a second coagulation bath held at 25° C. containing 25 wt % of acetone in water, where drawing by a factor of 1.5 was carried out. The fibers were then passed into a wash bath of water at 40° C., and then into hot water at 75° C., where drawing by a factor of 2.0 was carried out. The acetone content of the fibers thus obtained was 10 wt %. The fibers were then subjected to steam treatment using saturated water vapor at 98° C. for 170 seconds. The acetone content of the fibers after the steam treatment was 1.8 wt %. The fibers were next subjected to low-temperature drying at 50° C. for 6 minutes, thus reducing the water content to 19 wt % and the acetone content to 1.2 wt %. The fibers were then subjected to dry heat treatment at 160° C. for 10 seconds, thus forming a hollow structure in each fiber. After that, the fibers were subjected to hot drawing treatment, being drawn by a factor of 2.2 at 120° C. using a vapor quantity of 100 Kg/h. The fibers were then crimped using a stuffing box type crimping device under conditions of a heating temperature of 90° C. (Embodiment 8) or 98° C. (Embodiment 9), a speed of entry into the crimping device of 20 m/min, a NIP pressure of the feeding rollers in the box of $8\times10^5$Pa, and a stuffing pressure of $2\times10^5$Pa. The fibers were then subjected to heat treatment at 130° C. for 5 minutes. The bulkiness of the fibers was measured after the crimping and after the heat treatment. Moreover, high piles were manufactured using the crimped fibers thus obtained, and evaluation was carried out as described above. The results are shown in Table 3.

Comparative Examples 7, 8

Hollow fibers manufactured as in Embodiments 8 and 9 were crimped under the same conditions as in Embodiments 8 and 9, only the heating temperature was made to be 70° C. (Comparative Example 7) or 80° C. (Comparative Example 8). The fibers were then subjected to heat treatment at 130° C. for 5 minutes. The bulkiness of the fibers was measured after the crimping and after the heat treatment. Moreover, high piles were manufactured using the crimped fibers thus obtained, and evaluation was carried out as described above. The results are shown in Table 3.

TABLE 3

| | Crimping temperature | Bulkiness after crimping | Bulkiness after heat treatment | Pile evaluation* |
|---|---|---|---|---|
| Comparative Example 7 | 70° C. | 1.35 | 1.38 | Sliver production impossible |
| Comparative Example 8 | 80° C. | 1.15 | 1.28 | x |
| Embodiment 8 | 90° C. | 1.13 | 1.30 | ○ |
| Embodiment 9 | 98° C. | 1.03 | 1.32 | ◎ |

*Pile evaluation
◎: Highly satisfactory
○: Satisfactory
x: Unsatisfactory

As can be seen from Table 3, in Comparative Example 7 when the heating temperature during crimping was 70° C., the bulkiness was good after the crimping, but because the crimping was weak, a sliver could not be produced. Moreover, in Comparative Example 8 when the heating temperature during crimping was 80° C., the bulkiness after the heat treatment was close to the target value of 1.30, but rupturing of the hollow structure occurred in some of the fibers, and hence the feeling of volume was insufficient. In Embodiments 8 and 9 when the crimping was carried out while heating the fibers to 90° C. or 98° C., on the other hand, there was an excellent recovery in the bulkiness upon heat treatment, and the feeling of volume was satisfactory.

Industrial Applicability

The hollow shrinkable fiber of the present invention has a hollow form similar to that of natural fur, and exhibits good shrinkage of at least 15% upon dry heating, and can thus be used as a down hair fiber in a pile product, giving bulkiness, a lightweight feeling and warmth retention not achievable conventionally. By utilizing these excellent features, it is thus possible to produce an excellent natural-fur-like pile product.

What is claimed is:

1. A shrinkable fiber for pile, comprising a synthetic fiber having a marrow-like or network-like hollow core portion in the center of a cross section of the portion having a multiplicity of voids of different shape and formed irregularly and said skin portion having substantially few voids, whereby said fiber has cross section with a void ratio 10 to 50%, and said fiber being formed so as to be shrinkable with dry heat and have a dry heat shrinkage percentage of at least 15%.

2. The shrinkable fiber for pile according to claim 1, wherein said synthetic fiber comprises a polymer containing a copolymer of acrylonitrile and a halogen-containing vinyl monomer.

3. The shrinkable fiber according to claims 1 or 2 wherein, said void ratio in said fiber cross-section is 20% to 40%.

4. The shrinkable fiber according to claim 2 wherein, the fineness of said fiber is 10 dtex or less.

5. The shrinkable fiber according to claim 4 wherein, the fineness of said fiber is 2 to 7 dtex.

6. The shrinkable fiber according to claims 1, 2, 4 or 5 wherein, said fiber is a down hair component of a pile product, said product also including guard hair components, said down hair components being shorter and substantially finer than said guard hair components.

* * * * *

UNITED STATES PATENT AND TRADEMARK OFFICE

CERTIFICATE OF CORRECTION

PATENT NO. : 6,617,024 B2 
DATED : September 9, 2003
INVENTOR(S) : Shin Sudo et al.

It is certified that error appears in the above-identified patent and that said Letters Patent is hereby corrected as shown below:

Column 14,
Line 46, after "section of the" insert -- fiber and a compact skin portion in the periphery of the fiber cross section, said core --.
Line 49, delete "has cross section with a void ratio 10" and substitute -- has a cross section with a void ratio of 10 -- in its place.

Signed and Sealed this

Fourteenth Day of September, 2004

JON W. DUDAS
*Director of the United States Patent and Trademark Office*